US009359174B2

(12) United States Patent
Stitt et al.

(10) Patent No.: US 9,359,174 B2
(45) Date of Patent: Jun. 7, 2016

(54) COMPOSITE LIFTING BEAM

(71) Applicants: Douglas R. Stitt, South Beloit, IL (US); Thomas R. Eicher, Rockton, IL (US); Gregory F. Lucas, La Crescent, MN (US); Dan Eugene Mongan, Oregon, IL (US)

(72) Inventors: Douglas R. Stitt, South Beloit, IL (US); Thomas R. Eicher, Rockton, IL (US); Gregory F. Lucas, La Crescent, MN (US); Dan Eugene Mongan, Oregon, IL (US)

(73) Assignee: The Caldwell Group, Inc., Rockford, IL (US)

( * ) Notice: Subject to any disclaimer, the term of this patent is extended or adjusted under 35 U.S.C. 154(b) by 11 days.

(21) Appl. No.: 14/184,792

(22) Filed: Feb. 20, 2014

(65) Prior Publication Data

US 2015/0232303 A1 Aug. 20, 2015

(51) Int. Cl.
*B66C 1/00* (2006.01)
*B66C 1/10* (2006.01)

(52) U.S. Cl.
CPC ..... *B66C 1/10* (2013.01)

(58) Field of Classification Search
CPC ..... B66C 1/10; B66C 1/12; B66C 1/62; B66C 1/66
USPC ..... 294/81.21, 81.1, 81.5, 81.56, 907
See application file for complete search history.

(56) References Cited

U.S. PATENT DOCUMENTS

| | | | | | |
|---|---|---|---|---|---|
| 1,350,632 | A * | 8/1920 | Albrecht | 452/189 |
| 1,535,022 | A * | 4/1925 | Jenkins | 294/81.3 |
| 1,556,645 | A * | 10/1925 | Stoney et al. | 134/42 |
| 2,987,340 | A * | 6/1961 | Mattera | 294/81.2 |
| 3,010,751 | A * | 11/1961 | Day et al. | 294/81.2 |
| 3,304,115 | A * | 2/1967 | Brooks et al. | 294/81.5 |
| 3,343,861 | A * | 9/1967 | Sinicki | 294/81.2 |
| 3,519,303 | A * | 7/1970 | Gille | 294/81.6 |
| 4,289,090 | A * | 9/1981 | Bagby et al. | 118/630 |
| 4,397,493 | A * | 8/1983 | Khachaturian et al. | 294/81.1 |
| 4,909,555 | A * | 3/1990 | Blasi | 452/189 |
| 6,062,620 | A * | 5/2000 | Walker et al. | 294/67.31 |
| 7,093,729 | B2 * | 8/2006 | Monteil et al. | 212/178 |
| 7,562,499 | B2 | 7/2009 | Hillman | |
| 2002/0149216 | A1 * | 10/2002 | Teixeira | B66C 1/663 294/82.1 |
| 2011/0140469 | A1 * | 6/2011 | Plair | 294/81.1 |

(Continued)

FOREIGN PATENT DOCUMENTS

| | | | |
|---|---|---|---|
| CN | 101708804 | A | 5/2010 |
| CN | 202465025 | U | 10/2012 |

(Continued)

OTHER PUBLICATIONS

Daggett, Susan, A guide to selection of methacrylate, urethane and epoxy adhesives, Apr. 1, 2004, Composite Technology, http://www.compositesworld.com/articles/a-guide-to-selection-of-methacrylate-urethane-and-epoxy-adhesives.*

(Continued)

*Primary Examiner* — Gabriela Puig
(74) *Attorney, Agent, or Firm* — Reinhart Boerner Van Deuren P.C.

(57) ABSTRACT

A composite lifting beam and methods are provided. Such a lifting beam includes at least one beam element. A plurality of plate elements are mounted to the at least one beam element and are spaced apart along a length of the at least one beam element. The plurality of plate elements provide a first connection arrangement for connecting the beam to a lifting apparatus, and a second connection arrangement for connecting the beam to a load.

13 Claims, 10 Drawing Sheets

(56) References Cited

U.S. PATENT DOCUMENTS

| | | | | |
|---|---|---|---|---|
| 2013/0259633 | A1* | 10/2013 | Meyer et al. | 414/800 |
| 2015/0314994 | A1* | 11/2015 | Meyer | B66C 1/108 414/589 |
| 2015/0367517 | A1* | 12/2015 | Eisele | B29C 70/54 294/81.2 |

FOREIGN PATENT DOCUMENTS

| | | | |
|---|---|---|---|
| CN | 202717499 | U | 2/2013 |
| CN | 103145029 | A | 6/2013 |
| EP | 1351877 | A1 | 10/2003 |

OTHER PUBLICATIONS

Econony Chain Hoist, OZ Lifting Products LLC, "Compozite", printed on Jun. 26, 2013 from website http://www.ozliftingproducts.com/compozitedavitcrane.html; 3 pages.

Hydromatic Pultruded Rail System; Pump Installation and Service Manual; known prior to Feb. 20, 2014; 8 pages; Hydromatic Pentair Pump Group; Ashland, Ohio.

* cited by examiner

COMPOSITE LIFTING BEAM

FIELD OF THE INVENTION

This invention generally relates to lifting equipment, and more specifically to lifting beams.

BACKGROUND OF THE INVENTION

Lifting beams are utilized in various applications to aid in lifting a load. Typically, a lifting beam is attached to an end of a lifting apparatus such as a crane or the like. The lifting beam provides connection points for connecting it to the load. The lifting beam is thus interposed between the end of the lifting apparatus and the load itself, and functions to distribute the forces of the load to effectuate safe and efficient lifting and movement of the load.

Unfortunately, contemporary lifting beams tend to be relatively heavy given the primary use of steel in the construction thereof as well as their overall complexity. It has been found that use of such beams adds an undesirable amount to the overall loading of the lifting apparatus when the combined weight of the lifting beam itself and the load are considered. Further, such lifting beams tend to be quite costly given the use of steel in their construction and their complexity. Yet further, such lifting beams are relatively heavy from the standpoint of manual handling.

Accordingly, there is a need in the art for a lifting beam that advantageously performs its load bearing and balancing functionality but without the significant added weight and cost of contemporary beams.

The invention provides such a lifting beam. These and other advantages of the invention, as well as additional inventive features, will be apparent from the description of the invention provided herein.

BRIEF SUMMARY OF THE INVENTION

In one aspect, the invention provides a lifting beam that includes a plurality of plate elements that allow for the quick and efficient connection of the lifting beam between a lifting apparatus and a load. An embodiment of a lifting beam according to this aspect includes at least one beam element. A plurality of plate elements are mounted to the at least one beam element. One or more of the plurality of plate elements provide a first connection arrangement for connecting the lifting beam to a lifting apparatus. One or more of the plurality of plate elements provide a second connection arrangement for connecting the lifting beam to a load.

In certain embodiments, the plurality of plate elements are secured to the at least one beam element by an adhesive. The at least one beam element can include a first and a second beam element. The first and second beam elements are arranged in an imposed-spaced relationship such that a clearance gap is formed therebetween. The plurality of plate elements are mounted to each of the first and second beam elements within the clearance gap, and in some embodiments, may be mounted as such using an adhesive.

In embodiments including a first and a second beam element, the first beam element may be arranged such that it is slidable relative to the second beam element such that the lifting beam has an overall adjustable length. The first beam element is slidable within an interior hollow space of the second beam element. A locking arrangement is also provided for locking the first beam element relative to the second beam element at a fixed position.

In certain embodiments, the plurality of plate elements may include a pair of plate elements and a bail plate positioned between the pair of plate elements. In such an embodiment, the first connection arrangement may be provided by the bail plate, and the second connection arrangement may be provided by the pair of plate elements. The first connection arrangement may also be provided by the pair of plate elements and the bail plate, and the second connection arrangement may be provided by the pair of plate elements.

In certain embodiments, the plurality of plate elements includes a pair of plate elements. The pair of plate elements provide the first connection arrangement and the second connection arrangement.

In another aspect, the invention provides a lifting beam that advantageously minimizes material usage while maintaining the desirable characteristics of a lifting beam. An embodiment according to this aspect includes at least one beam element formed from a composite material. A plurality of plate elements are mounted to the at least one beam element. The plurality of plate elements are mounted to the at least one beam element spaced apart from one another along a length of the at least one beam element.

In certain embodiments, the at least one beam element may include a first and a second beam element arranged in an opposed-spaced relationship such that a clearance gap is formed therebetween. The plurality of plate elements are mounted to the first and second beam elements within the clearance gap using an adhesive.

In certain other embodiments, the at least one beam element includes a first and a second beam element which are slidable relative to one another such that the lifting beam has an overall adjustable length.

In certain embodiments, one or more of the plurality of plate elements provide a first connection arrangement for connecting the lifting beam to a lifting apparatus, and one or more of the plurality of plate elements provide a second connection arrangement for connecting the lifting beam to a load. The plurality of plate elements may include a pair of plate elements and a bail plate positioned between the pair of plate elements. The first connection arrangement may be formed on the bail plate, and the second connection arrangement may be formed on the pair of plate elements. In another embodiment, the first connection arrangement may be formed on the bail plate and the pair of plate elements, and the second connection arrangement may be formed on the pair of plate elements.

In certain embodiments, the plurality of plate elements includes a pair of connection plates. The first connection arrangement and the second connection arrangement are formed on the pair of connection plates.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
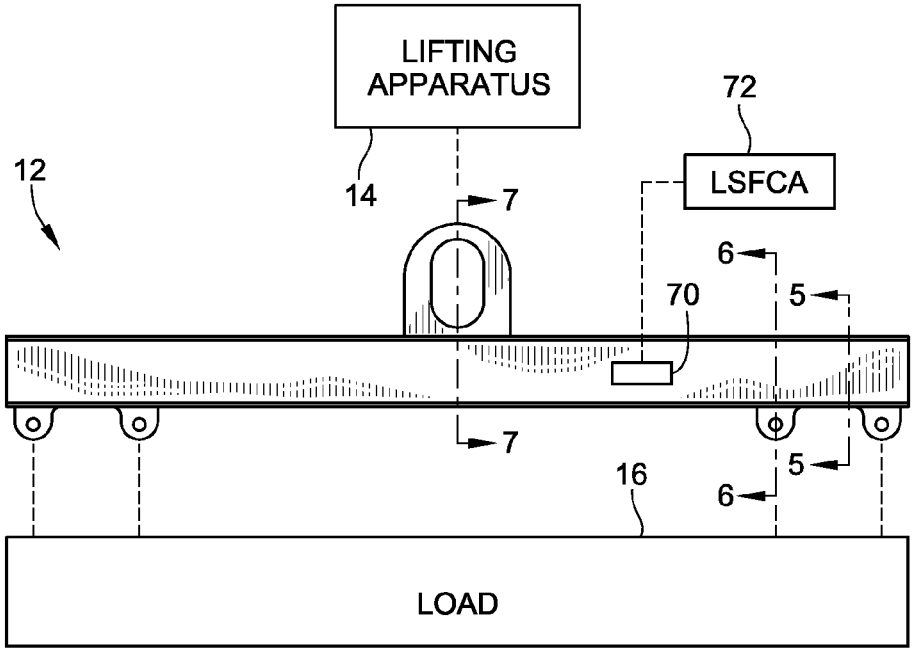
FIG. 1 is front view of a first embodiment of a lifting beam according to the teachings of the present invention shown in a schematic operational environment.

Turning now to the drawings, FIG. 1 illustrates a first embodiment of a composite lifting beam referred to herein as beam assembly 12. Beam assembly 12 is shown connected to a lifting apparatus 14 by a connection arrangement of beam assembly 12. Lifting apparatus 14 is shown schematically as the same may be embodied by various structures, including but not limited to, cranes, hoists, etc. A load 16 is connected to beam assembly 12 at a plurality of connection points defined by a connection arrangement of beam assembly 12. Load 16 is also shown schematically, as it is readily recognized that lifting beams are utilized in a variety of applications to assist in the lifting of a variety of different types of loads. Further, as will be described in greater detail below, the number and type of connection points from beam assembly 12 to load 16, as well as the number and type of connection points from beam assembly 12 to lifting apparatus 14 can vary depending upon the particular lifting apparatus, the particular load, the desired stress constraints on beam assembly 12, etc.

Further, multiple beam assemblies 12 may be connected between lifting apparatus 14 and load 16. These multiple beam assemblies 12 may be arranged sequentially, or alternatively, may be arranged in the same plane and connected to one another in a variety of arrangements when viewed from above, e.g. a square or rectangular shape, a T-shape, an H-shape, an I-shape, etc.

Lifting beam assembly 12 may also include a sensor 70 for sensing a load of beam assembly 12. More specifically, sensor 70 is operable to provide a visual indication of the stress condition of a beam element of lifting beam assembly 12. Such a visual indication may be, for non-limiting example, a color indication on a sticker, a sticker that will tear at a given deformation of beam assembly 12, a capillary tube that will break at a given deformation of beam assembly 12, etc. Alternatively, sensor 70 may be an electronic sensor, e.g. a strain gauge, which is connected to a load sensing feedback and control arrangement (LSFCA) 72. LSFCA may include a programmable controller configured to receive and interpret a signal from sensor 70, and thereafter provide an indication of a load state of lifting beam assembly 12 to an output device.

Figure 2:
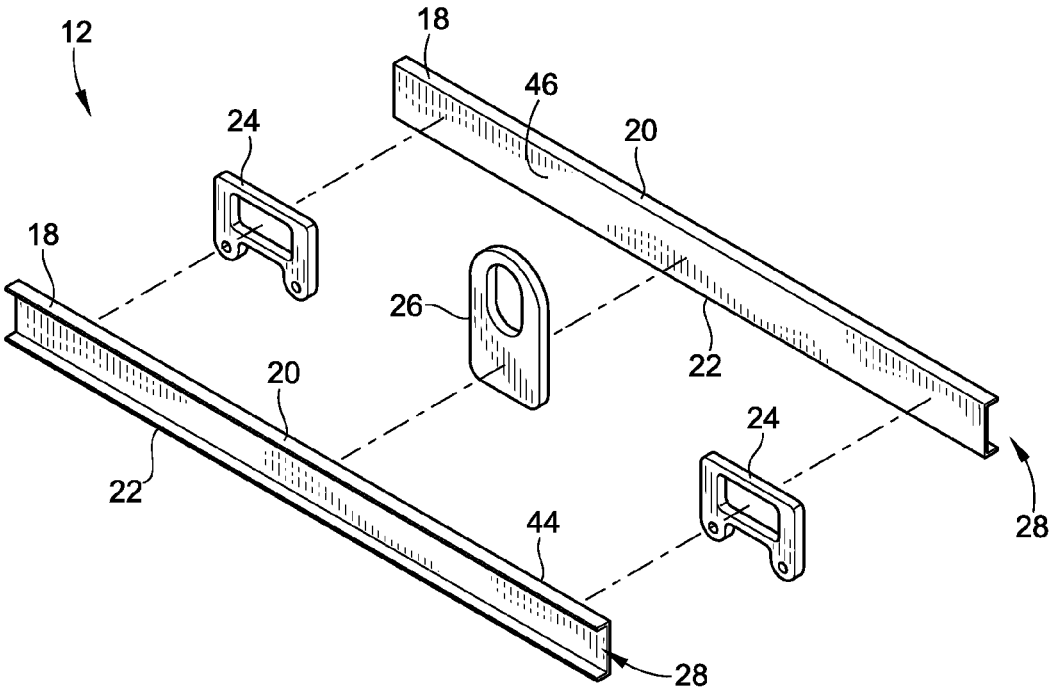
FIG. 2 is a perspective exploded view of the lifting beam of FIG. 1.

Turning now to FIG. 2, beam assembly 12 is shown in an exploded view. Beam assembly 12 includes opposed beam elements 18. Each beam element 18 extends between top and bottom surfaces 20, 22 and has a channel 28 therethrough. As can be readily seen from inspection of FIG. 2, each beam element 18 has a generally C-shaped cross-sectional profile. Those skilled in the art will recognize, however, that other cross-sectional profiles are possible depending upon application and expected loading characteristics, for non-limiting example square/rectangular, round, angle, W-shaped, I-shaped, H-shaped etc. Further, although the following description will discuss the use of a pair of opposed beam elements 18, it is entirely possible to mount the below discussed plate elements to a single beam element at any suitable location thereon. As such, it will be understood that beam assembly 12 may incorporate at a minimum at least one beam element, as opposed to a pair of beam elements 18.

Beam elements 18 may be advantageously made from a pultruded composite material, i.e. a composite material formed by pultrusion. These materials have been found to exhibit a good temperature rating, and also provide significantly high strength to accommodate applications of the lifting beam assembly 12. As an example of such a material, Pultex 1625 series thermoset vinyl-ester class 1 may be utilized. It has been found that such a material advantageously meets the required strength parameters of beam assembly 12, while overcoming existing problems in the art by providing a significant reduction in overall weight. However, composite beams formed by other processes not limited to pultrusion may also be utilized. Further, other composite materials may also be utilized to achieve the advantages herein, and thus the specification of Pultex 1625 above is only one, non-limiting, example. As such, the beam elements herein are not limited to any specific process of manufacture or any specific composite material, but may be formed by a variety of composite materials and composite manufacturing processes recognized by those of skill in the art.

As shown in FIG. 2, beam elements 18 are identical to one another, however, it is contemplated that one beam element 18 may have different dimensional characteristics than the other. As shown in FIG. 2, beam elements 18 are in opposed-spaced relation with a plurality of plate elements in the form of a pair of load plates 24 and a bail plate 26 positioned between load plates 24. The plurality of plate elements defines the aforementioned connection arrangements for connecting beam assembly 12 to lifting apparatus 14 and load 16.

Each of load plates 24 and bail plate 26 are positioned within a clearance gap 48 defined between interiorly facing surfaces 44, 46 of each beam element 18. Load plates 24 and bail plate 26 may be formed from metal, composites, or any other suitable material depending upon application. Load plates 24 and bail plate 26 have a common thickness and are secured to interiorly facing surfaces 44, 46 of beam elements 18 via adhesive. Various adhesives are contemplated, for example but not limited to methacrylate adhesive, as well as urethane-based adhesives. Additionally, in the case of composite material plate elements, these may be joined to beam elements 18 by any known composite-to-composite joining technique.

It will be recognized that depending upon the specific type of adhesive used, surface preparation of the bonding surfaces may be required. For example, a light abrasion may be necessary on the interior surfaces of beam elements 18 and/or the outer surfaces of load plates 24 and bail plate 26. Due to the advantageous use of composite materials for beam elements 18, as well as the use of adhesives as opposed to conventional mounting hardware, beam assembly 12 exhibits a high strength and low weight unlike contemporary designs. Indeed, the overall weight of beam assembly 12 permits for manual handling, which has been to this point difficult if not impossible via contemporary beam assemblies. It should be noted that the adhesive utilized is not limited to the specific examples described above, and various adhesives may be employed depending upon application.

Figure 3:
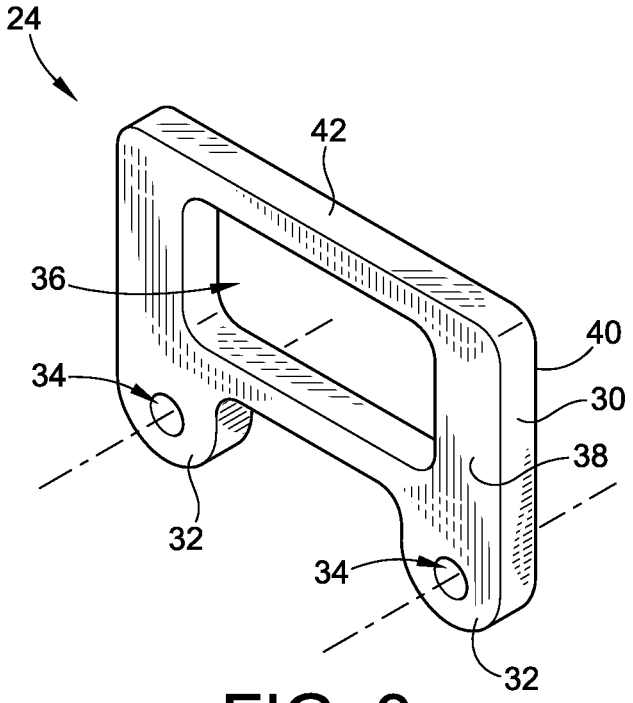
FIG. 3 is a perspective view of a load plate of the lifting beam of FIG. 1.

With reference now to FIG. 3, load plates 24 will be described in greater detail. Only a single load plate 24 is shown in FIG. 3, as the same are identical to one another. Load plate 24 has a body portion 30 and lug portions 32 which extend from body portion 30. A lug aperture 34 is formed in each lug portion 32. Lug aperture 34 is sized to receive various connection hardware such as clevises, hooks, etc., and forms an embodiment of the connection arrangement for connecting beam assembly 12 to load 16. Further, although two lug portions 32 are shown extending from body portion 30, it is contemplated that fewer or greater lug portions 32 with their associated lug apertures 34 may be utilized. Further, it is possible to use fewer lug apertures 34 than the maximum thereof provided for actual connection to load 16. Body portion 30 includes a body opening 36 which is generally rectangular in shape. Body opening 36 advantageously reduces the overall weight of each load plate 24.

Load plate 24 extends between opposed outer surfaces 38 and 40 and has a generally constant thickness. Additionally, load plate 24 has a generally flat top surface 42 as shown in FIG. 3.

Figure 4:
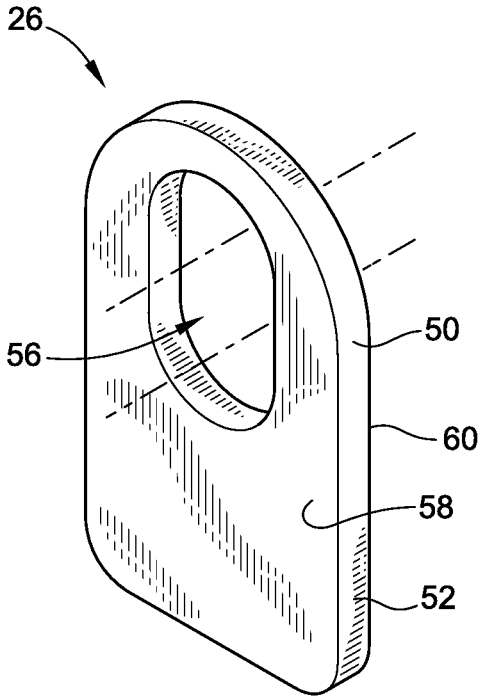
FIG. 4 is a perspective view of a bail plate of the lifting beam of FIG. 1.

Turning now to FIG. 4, bail plate 26 will be discussed in greater detail. Bail plate 26 extends between opposed outer side surfaces 58, 60 with a constant thickness. Bail plate 26 includes a connection portion 50 and a body portion 52. Connection portion 50 extends upwardly from body portion 52 and defines a connection aperture 56 therethrough. Connection aperture 56 is sized to receive the connection of lifting apparatus 14 (See FIG. 1) which may be a hook or other device, and thus forms the connection arrangement for connecting beam 12 to lifting apparatus 14. As such, it will be recognized that the particular geometry of connection aperture 56 may vary. Additionally, more than one connection aperture 56 may be provided. Unlike load plates 24, body portion 52 of bail plate 26 does not include an opening therethrough, however, it is contemplated that the same may incorporate such an opening for weight reduction purposes. As was the case with load plates 24, bail plate 26 may be manufactured from various materials, and as one example, may be formed from an A36 steel.

Figure 5:
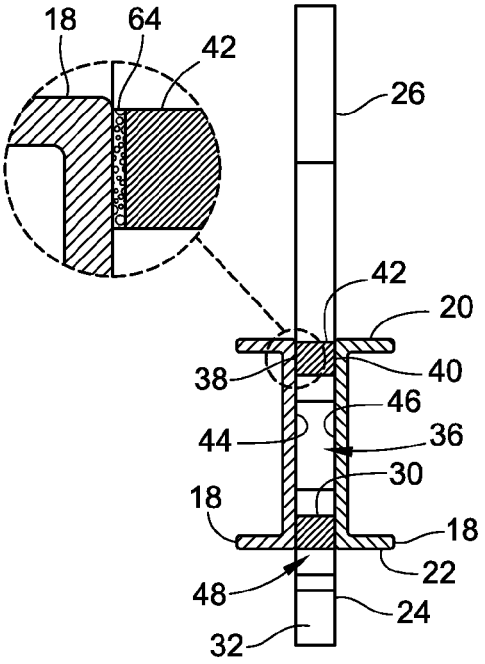
FIG. 5 is a cross sectional view of the lifting beam of FIG. 1.

Turning now to FIG. 5, the same illustrates a cross-sectional view taken through the center of the right-most load plate 24 shown in FIG. 1. As can be seen in this view, the interior surfaces 44, 46 of beam elements 18 are affixed to outer side surfaces 58, 60 load plate 24 using the aforementioned adhesives 64. As can also be seen in this view, top surface 42 of load plate 24 is recessed below top surfaces 20 of beam elements 18. Lug portions 32 extend below bottom surfaces 22 of beam elements 18 so that lug aperture 34 (See FIG. 3) is exposed. It will be recognized that the foregoing configuration is the same for the other one of load plates 24.

Figure 6:
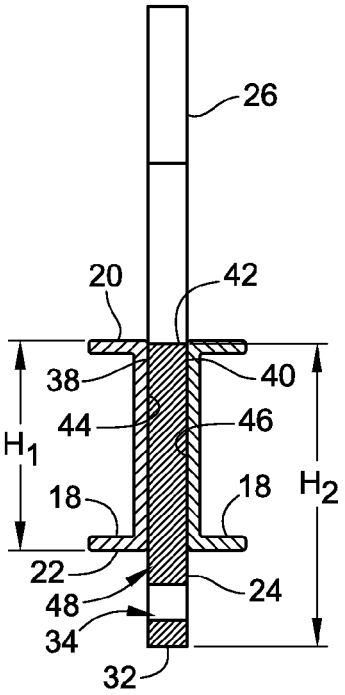
FIG. 6 is another cross sectional view of the lifting beam of FIG. 1.

With reference now to FIG. 6, the same illustrates a cross-sectional view taken through load plate 24 at section line 6-6 shown in FIG. 1. As can be seen in this view, each beam element 18 has an overall $H_1$ that is less than an overall $H_2$ of load plate 24. Lug apertures 34 are exposed below bottom surfaces 22 of beam elements 18 for connection to load 16 shown in FIG. 1.

Figure 7:
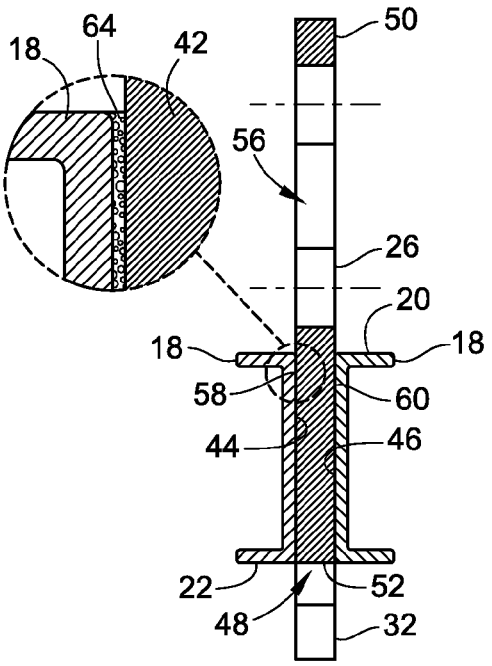
FIG. 7 is another cross sectional view of the lifting beam of FIG. 1.

With reference to FIG. 7 the same illustrates a cross-sectional view taken through the center of bail plate 26 shown in FIG. 1. As can be seen in this view, interior surfaces 44, 46 of beam elements 18 are attached to outer side surfaces 58, 60 of load plate 26 by way of the aforementioned adhesives 64. Connection portion 50 extends above upper surfaces 20 of beam elements 18 to expose connection aperture 56. Due to the equivalent thickness of each of load plates 24 and bail plate 26, each of outer side surfaces 38, 58 situated in a common plane. Likewise, each of outer side surfaces 40, 60 are also situated in a common plane.

Figure 8:
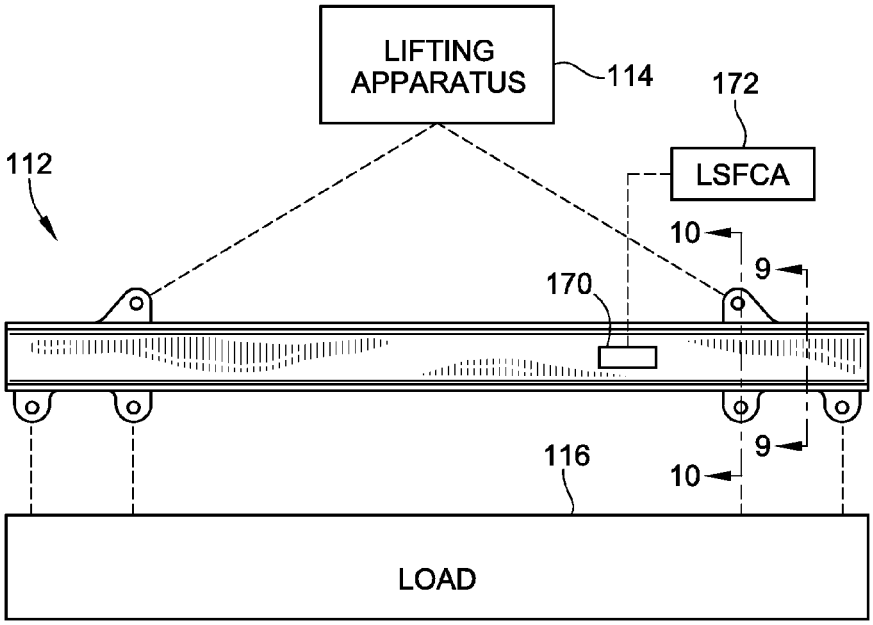
FIG. 8 is a front view of a second embodiment of a lifting beam according to the teachings of the present invention.

Turning now to FIGS. 8-12, a second embodiment of a composite lifting beam is shown and referred to herein simply as beam assembly 112. With particular reference to FIG. 8, beam assembly 112 is connected to a lifting apparatus 114 via a connection arrangement as well as a load 116 via a connection arrangement in a similar manner as described above. However, it will be recognized from comparison of FIG. 8 to FIG. 1, that beam assembly 112 does not incorporate a centralized bail plate. Further, the number and type of connection points from beam assembly 112 to load 116, as well as the number and type of connection points from beam assembly 112 to lifting apparatus 114 can vary depending upon the particular lifting apparatus, the particular load, the desired stress constraints on beam assembly 112, etc.

Further, multiple beam assemblies 112 may be connected between lifting apparatus 114 and load 116. These multiple beam assemblies 112 may be arranged sequentially, or alternatively, may be arranged in the same plane and connected to one another in a variety of arrangements when viewed from above, e.g. a square or rectangular shape, a T-shape, an H-shape, an I-shape, etc.

As shown in FIG. 8, lifting beam assembly 112 may also include a sensor 170 that can provide a visual indication, e.g. a color indication, of the current load state of a beam element of lifting beam assembly 112. Such a visual indication may be, for non-limiting example, a color indication on a sticker, a sticker that will tear at a given deformation of beam assembly 112, a capillary tube that will break at a given deformation of beam assembly 112, etc. Alternatively, sensor 170 may be an electronic sensor, e.g. a strain gauge, which is connected to a load sensing feedback and control arrangement (LSFCA) 172. LSFCA may include a programmable controller configured to receive and interpret a signal from sensor 170, and thereafter provide an indication of a load state of lifting beam assembly 12 to an output device.

Figure 9:
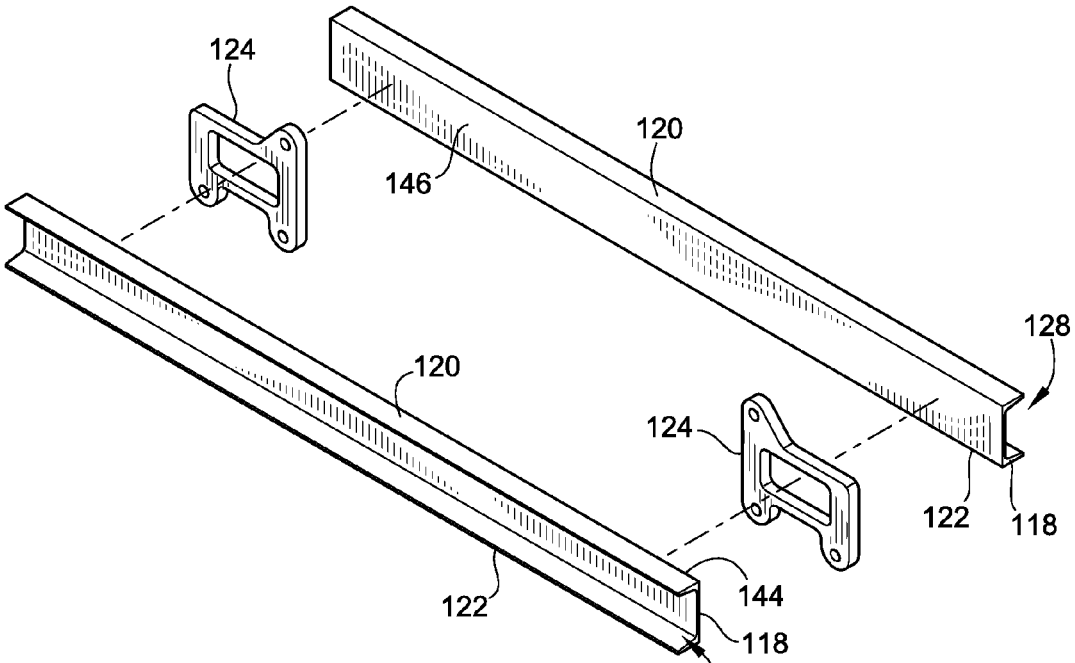
FIG. 9 is a perspective exploded view of the lifting beam of FIG. 8.

Turning now to FIG. 9, beam assembly 112 includes a pair of opposed beam elements 118. Additionally, a plurality of plate elements in the form of a pair of connection plates 124 are disposed within a clearance gap 148 (See FIG. 11) defined between interior surfaces 144, 146 of beam elements 118. The plurality of plate elements define the aforementioned connection arrangements for connecting beam assembly 112 to lifting apparatus 114 and load 116. These plate elements may be formed from metal, composites, or any other suitable material depending upon application. Each beam element 118 includes a top surface 120 and a bottom surface 122, as well as a channel 128 extending along the length of each respective beam element 118.

Beam elements 118 may be fabricated from a composite material for example a vinyl-ester material, or other composite materials, which may or may not be formed by pultrusion. In other words, beam elements 118 may be formed from the same materials and present the same advantages as that discussed above relative to beam elements 18. Also, it will be recognized that each beam element 118 has a generally C-shaped cross-sectional profile, also similar to beam elements 18 described above, although other profiles (for non-limiting example those discussed above) are entirely possible depending upon application and expected loading characteristics, for non-limiting example square/rectangular, round, angle, W-shaped, I-shaped, H-shaped etc. Further, although the following description will discuss the use of a pair of opposed beam elements 118, it is entirely possible to mount the below discussed plate elements to a single beam element at any suitable location thereon. As such, it will be understood that beam assembly 112 may incorporate at a minimum at least one beam element, as opposed to a pair of beam elements 118.

Figure 10:
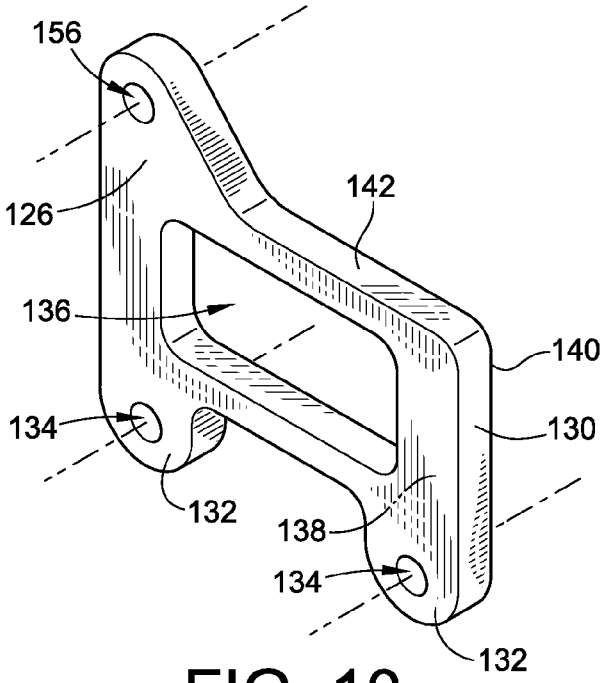
FIG. 10 is a perspective view of a load plate of the lifting beam of FIG. 8.

Turning now to FIG. 10, connection plate 124 is shown in greater detail. The connection plates 124 shown in FIG. 8 are identical, and as such, it will be recognized that the following description applies equally to both. Connection plate 124 includes a body portion 130, a bail connection portion 126 extending upwardly from body portion 130, and two load connection portions 132 extend below body portion 130. A greater number of bail connection portions 126 may be utilized depending upon application. Similarly, fewer or greater load connection portions 132 may also be utilized depending upon application.

Body portion 130 includes a centralized body opening 136 which advantageously reduces the overall weight of connection plate 124. Connection plate 124 extends between exposed outer side surfaces 138, 140. Additionally, body portion 130 defines a generally flat top surface 142.

Figure 11:
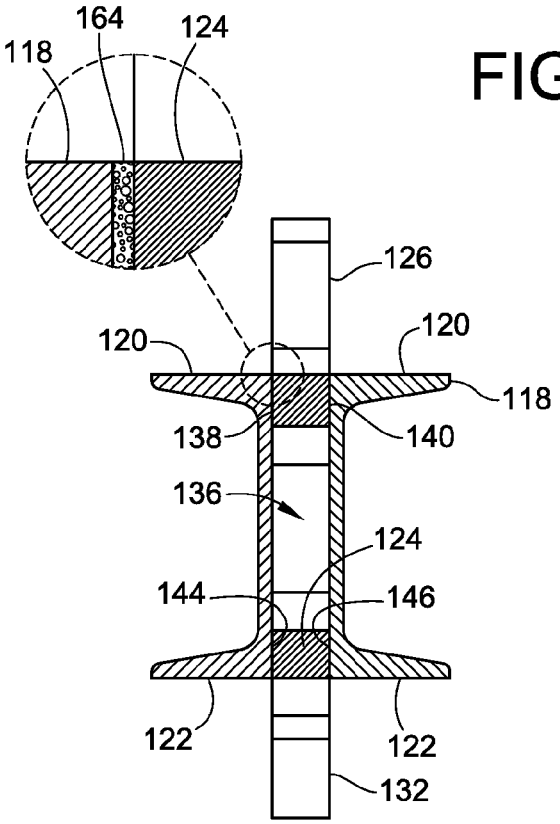
FIG. 11 is a cross sectional view of the lifting beam of FIG. 8.

Turning now to FIG. 11, a cross-section of beam assembly 112 is illustrated in the region of connection plate 124. Outer side surfaces 138, 140 of connection plate 124 are adhered to interior surfaces 144, 146 of beam elements 118 using an adhesive 164. As was the case with the embodiment described above, adhesive 164 made for example a methacrylate adhesive or a urethane adhesive. However, other adhesives are equally contemplated and their selection will entirely depend upon application. Additionally, the adhered surfaces of all components may be abraded to increase adhesion. Further, in the case of composite material plate elements, any known composite-to-composite joining technique may be employed for joining connection plates 124 to beam elements 118.

As can also be seen in FIG. 11, bail connection portion 126 extends out of clearance gap 148 beyond top surfaces 120 of each beam element 118. Similarly, load connection portion 132 extends out of clearance gap 148 and beyond bottom surfaces 122.

Figure 12:
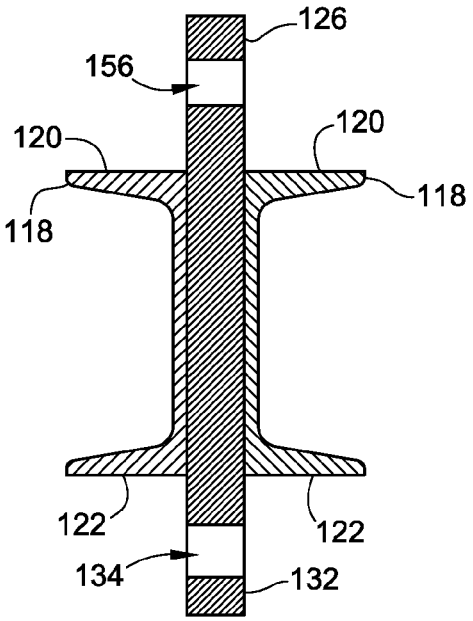
FIG. 12 is another cross sectional view of the lifting beam of FIG. 8.

Turning now to FIG. 12, another cross-sectional view of beam assembly 112 is illustrated taken through connection plate 124 at a location different than that shown in FIG. 11. As can be seen in this view, connection aperture 156 of bail connection portion 126 is aligned with connection aperture 134 of load connection portion 132. Connection apertures 156 thus form the connection arrangement for connecting beam assembly 112 to lifting apparatus 114, and connection apertures 134 thus form the connection arrangement for connecting beam assembly 112 to load 116. Such a configuration advantageously distributes the loading across connection plate 124 such that overall dimensional sizing of connection plate 124 is reduced.

Figure 13:
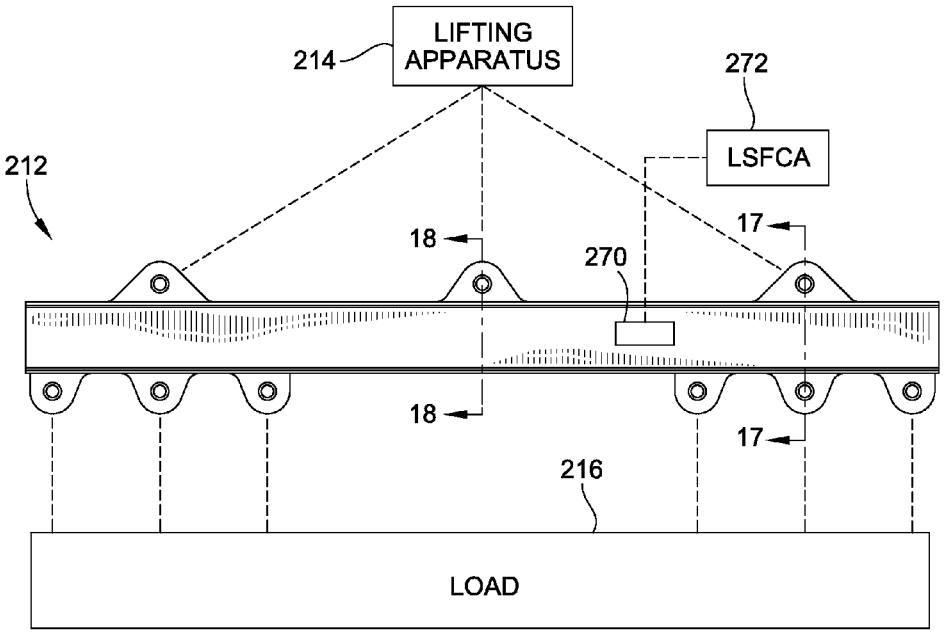
FIG. 13 is a front view of a third embodiment of a lifting beam according to the teachings of the present invention.

Turning now to FIGS. 13-18, a third embodiment of a composite lifting beam is shown and referred to herein simply as beam assembly 212. With particular reference to FIG. 13, beam assembly 212 is connected to a lifting apparatus 214 by a connection arrangement of beam assembly 212, as well as a load 216 by a connection arrangement of beam assembly 212. However, it will be recognized from comparison of FIG. 13 to FIG. 1 above, that beam assembly 212 does not incorporate a centralized bail plate. Further, the number and type of connection points from beam assembly 212 to load 216, as well as the number and type of connection points from beam assembly 212 to lifting apparatus 214 can vary depending upon the particular lifting apparatus, the particular load, the desired stress constraints on beam assembly 212, etc.

Further, multiple beam assemblies 212 may be connected between lifting apparatus 214 and load 216. These multiple beam assemblies 212 may be arranged sequentially, or alternatively, may be arranged in the same plane and connected to one another in a variety of arrangements when viewed from above, e.g. a square or rectangular shape, a T-shape, an H-shape, an I-shape, etc.

As shown in FIG. 13, lifting beam assembly 212 may also include a sensor 270 that can provide a visual indication, e.g. a color indication, of the current load state of a beam element of lifting beam assembly 212. Such a visual indication may be, for non-limiting example, a color indication on a sticker, a sticker that will tear at a given deformation of beam assembly 212, a capillary tube that will break at a given deformation of beam assembly 212, etc. Alternatively, sensor 270 may be an electronic sensor, e.g. a strain gauge, which is connected to a load sensing feedback and control arrangement (LSFCA) 272. LSFCA may include a programmable controller configured to receive and interpret a signal from sensor 270, and thereafter provide an indication of a load state of lifting beam assembly 272 to an output device.

Figure 14:
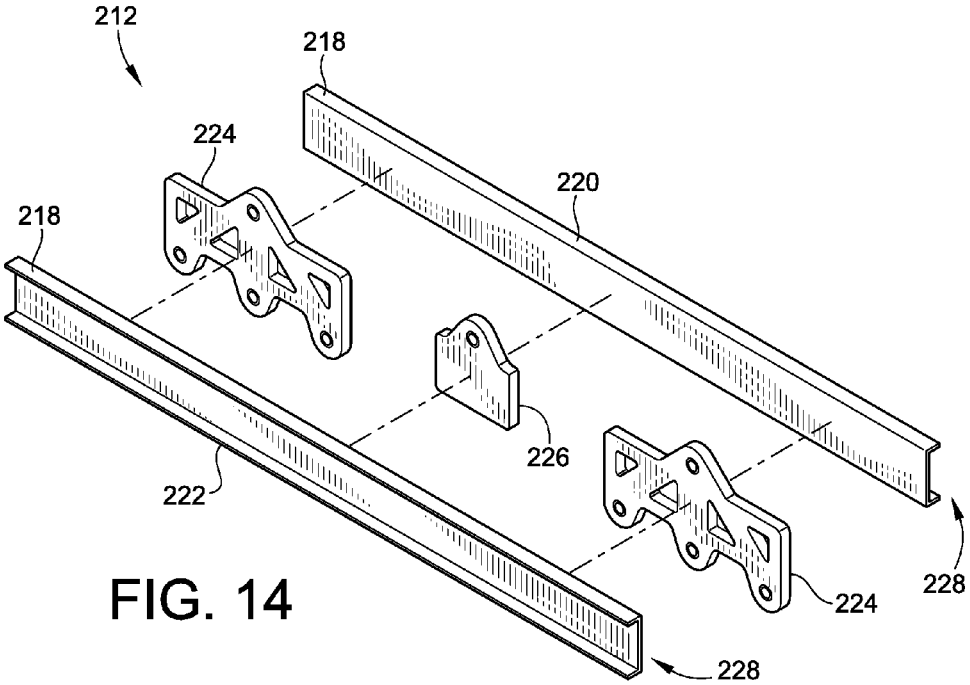
FIG. 14 is a perspective exploded view of the embodiment of FIG. 13.

Turning now to FIG. 14, beam assembly 212 includes a pair of opposed beam elements 218. Additionally, a plurality of plate elements in the form of a pair of connection plates 224 and a bail plate 226 are disposed within a clearance gap 248 (See FIG. 17) defined between interior surfaces 244, 246 of beam elements 218. The plurality of plate elements defines the aforementioned connection arrangements for connecting beam assembly 212 to lifting apparatus 214 and load 216. These plate elements may be formed from metal, composites, or any other suitable material depending upon application. Each beam element 218 includes a top surface 220 and a bottom surface 222, as well as a channel 228 extending along the length of each respective beam element 218.

Beam elements 218 may be fabricated from a composite material for example a vinyl-ester material, or other composite materials, which may or may not be formed by pultrusion. In other words, beam elements 218 may be formed from the same materials and present the same advantages as that discussed above relative to beam elements 18, 118. Also, it will be recognized that each beam element 218 has a generally C-shaped cross-sectional profile, also similar to beam elements 18, 118 described above, although other profiles are entirely possible, depending upon application and expected loading characteristics, for non-limiting example square/rectangular, round, angle, W-shaped, I-shaped, H-shaped etc. Further, although the following description will discuss the use of a pair of opposed beam elements 218, it is entirely possible to mount the below discussed plate elements to a single beam element at any suitable location thereon. As such, it will be understood that beam assembly 212 may incorporate at a minimum at least one beam element, as opposed to a pair of beam elements 218.

Figure 15:
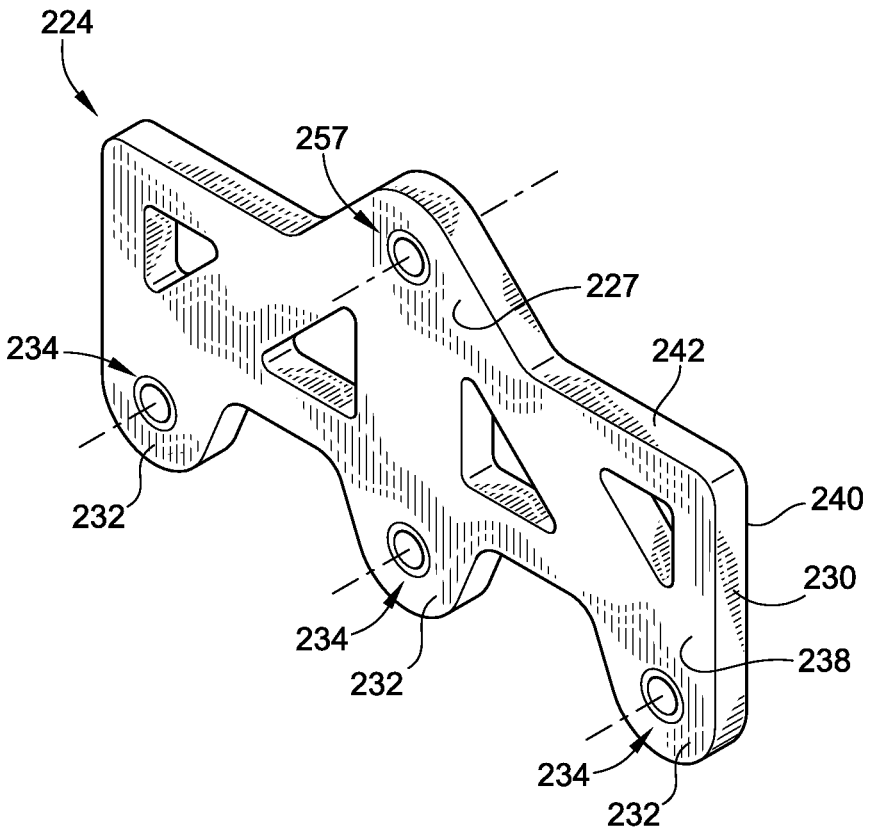
FIG. 15 is a perspective view of a load plate of the lifting beam of FIG. 13.

Turning now to FIG. 15, connection plate 224 is shown in greater detail. The connection plates 124 shown in FIG. 13 are identical, and as such, it will be recognized that the following description applies equally to both. Connection plate 224 includes a body portion 230, a bail connection portion 227 extending upwardly from body portion 230, and three load connection portions 232 extend below body portion 130. A greater number of bail connection portions 227 may be utilized depending upon application. Similarly, fewer or greater load connection portions 232 may also be utilized depending upon application. Bail connection portion 227 includes an aperture 257 therethrough for connection to lifting apparatus 214, and thus defines the connection arrangement for connecting beam assembly 212 to lifting apparatus 214. Load connection portions 232 include apertures 234 for load connection, and thus define the connection arrangement for connecting beam assembly 212 to load 216. Body portion 230 includes various openings which advantageously reduce the overall weight of connection plate 224. Connection plate 224 extends between exposed outer side surfaces 238, 240. Additionally, body portion 230 defines a generally flat top surface 242.

Figure 16:
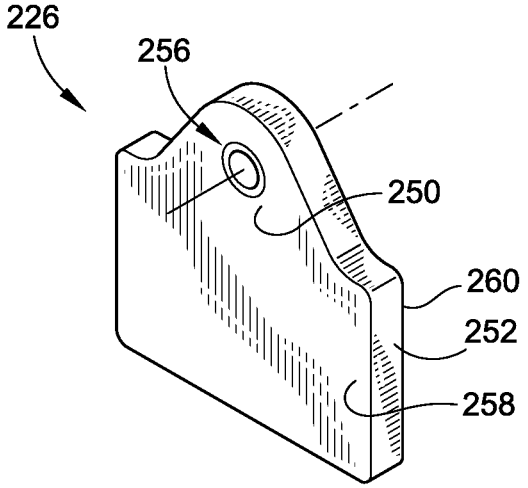
FIG. 16 is a perspective view of a bail plate of the lifting beam of FIG. 13.

With brief reference to FIG. 16, bail plate 226 also includes a body portion 252 and a connection portion 250 extending upwardly from body portion 252. A connection aperture 256 is formed through connection portion 250 and facilitates connection to lifting apparatus 214. It will be recognized that both bail connection portions 227 of connection plates 224 and/or connection portion 250 of bail plate 226 may be utilized for connection to lifting apparatus 214.

Figure 17:
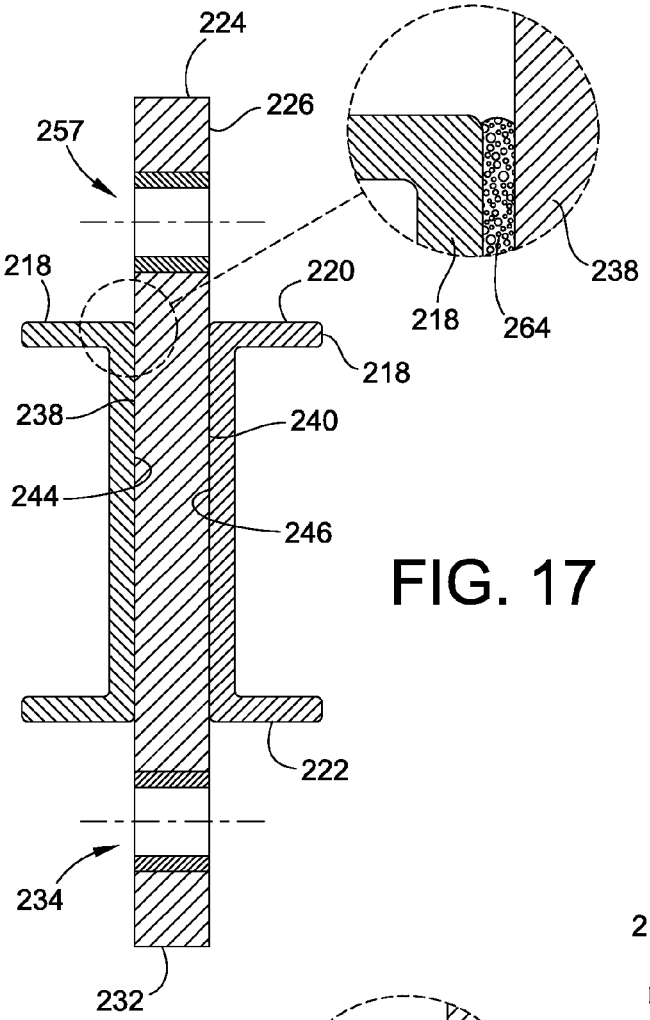
FIG. 17 is a cross sectional view of the lifting beam of FIG. 13.

Turning now to FIG. 17, a cross-section of beam assembly 212 is illustrated in the region of connection plate 224. Outer side surfaces 238, 240 of connection plate 224 are adhered to interior surfaces 244, 246 of beam elements 218 using an adhesive 264. As was the case with the embodiments described above, adhesive 264 made for example a methacrylate adhesive or a urethane adhesive. However, other adhesives are equally contemplated and their selection will entirely depend upon application. Additionally, the adhered surfaces of all components may be abraded to increase adhesion. Further, in the case of composite plate elements, any known composite-to-composite joining technique may be employed for joining connection plates 224 to beam elements 218.

As can also be seen in FIG. 17, bail connection portion 226 extends out of clearance gap 248 beyond top surfaces 220 of each beam element 218. Similarly, load connection portion 232 extends out of clearance gap 248 and beyond bottom surfaces 222.

Figure 18:
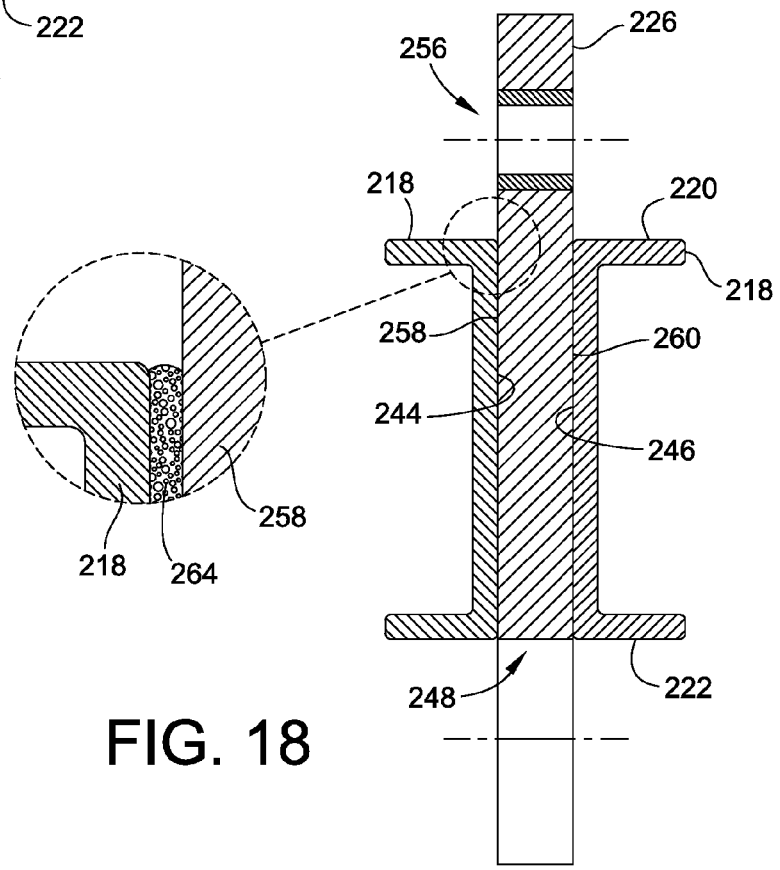
FIG. 18 is another cross sectional view of the lifting beam of FIG. 13.

Turning now to FIG. 18, another cross-sectional view of beam assembly 212 is illustrated taken through bail plate 226. Bail plate 226 is also secured to beam elements 218 using and adhesive 264 in the same manner as describe above. More specifically, opposed outer side surfaces 258, 260 are adhered to opposed inner side surfaces 244 of 246 of the respective beam elements 218. Additionally, the adhered surfaces of all components may be abraided to increase adhesion.

Having described the structural attributes of the above three embodiments, a description will now be provided of a general method of fabricating a beam assembly as described above. First, a pair of composite beam elements is provided. These beam elements may be formed by any known composite fabrication technique and material, including but not limited to pultrusion. Thereafter, a plurality of plate elements are also provided, and arranged within a clearance gap between the beam elements. These plate elements are then adhered to opposed inner side surfaces of the beam elements as discussed above. Thereafter, and depending upon type of adhesive used, a curing process may also be performed.

Figure 19:
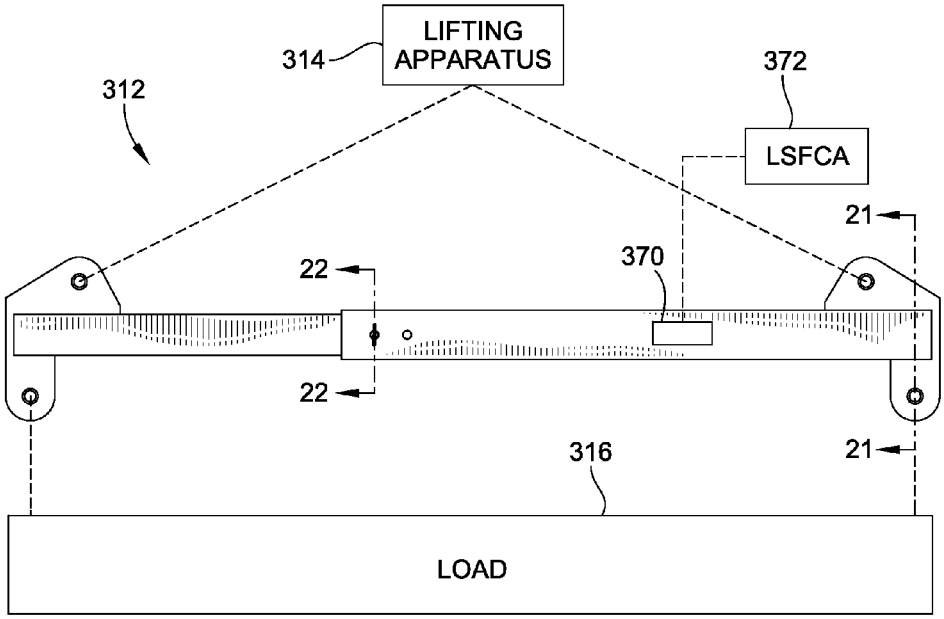
FIG. 19 is a front view of a fourth embodiment of a lifting beam according to the teachings of the present invention.

Turning now to FIGS. 19-22, a fourth embodiment of a composite lifting beam is shown and referred to herein simply as beam assembly 312. With particular reference to FIG. 19, beam assembly 312 is connected to a lifting apparatus 314 by a connection arrangement of beam assembly 312, as well as a load 316 by a connection arrangement of beam 312. However, it will be recognized from comparison of FIG. 19 to FIG. 1 above, that beam assembly 312 does not incorporate a centralized bail plate. Further, the number and type of connection points from beam assembly 312 to load 316, as well as the number and type of connection points from beam assembly 312 to lifting apparatus 314 can vary depending upon the particular lifting apparatus, the particular load, the desired stress constraints on beam assembly 312, etc.

Further, multiple beam assemblies 312 may be connected between lifting apparatus 314 and load 316. These multiple beam assemblies 312 may be arranged sequentially, or alternatively, may be arranged in the same plane and connected to one another in a variety of arrangements when viewed from above, e.g. a square or rectangular shape, a T-shape, an H-shape, an I-shape, etc.

As shown in FIG. 19, lifting beam assembly 312 may also include a sensor 370 that can provide a visual indication, e.g. a color indication, of the current load state of a beam element of lifting beam assembly 312. Such a visual indication may be, for non-limiting example, a color indication on a sticker, a sticker that will tear at a given deformation of beam assembly 312, a capillary tube that will break at a given deformation of beam assembly 312, etc. Alternatively, sensor 370 may be an electronic sensor, e.g. a strain gauge, which is connected to a load sensing feedback and control arrangement (LSFCA) 372. LSFCA may include a programmable controller configured to receive and interpret a signal from sensor 370, and thereafter provide an indication of a load state of lifting beam assembly 372 to an output device.

Figure 20:
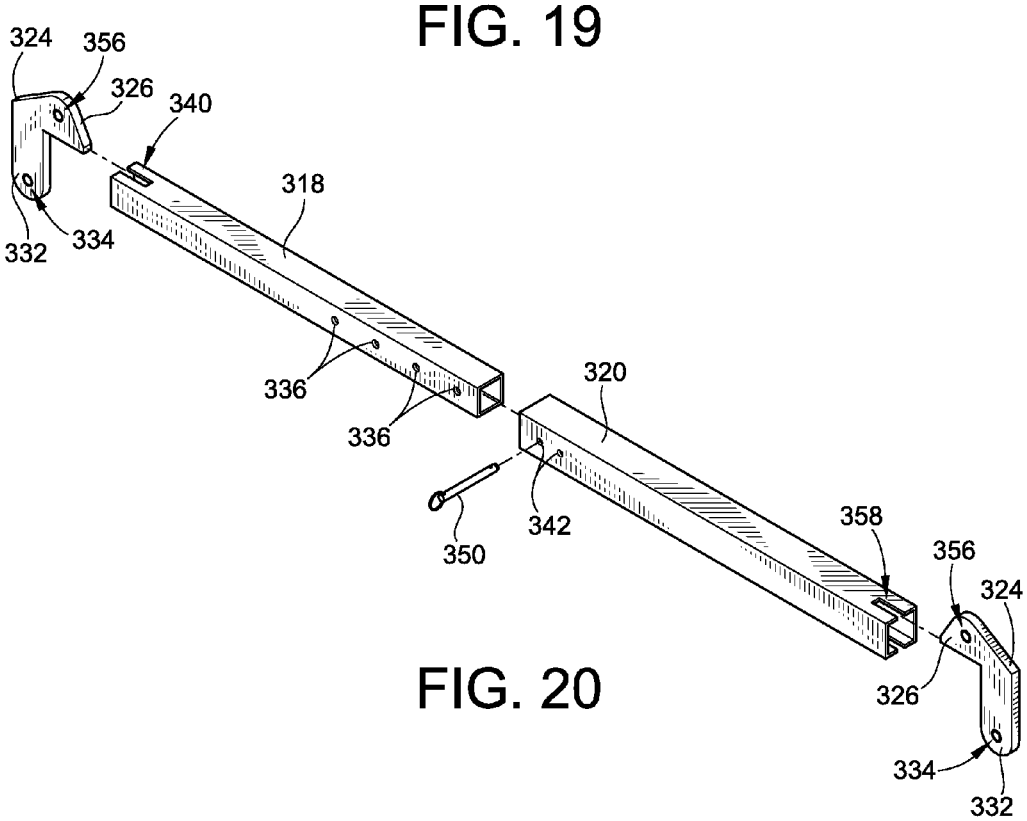
FIG. 20 is a perspective exploded view of the lifting beam of FIG. 19.
Figure 21:
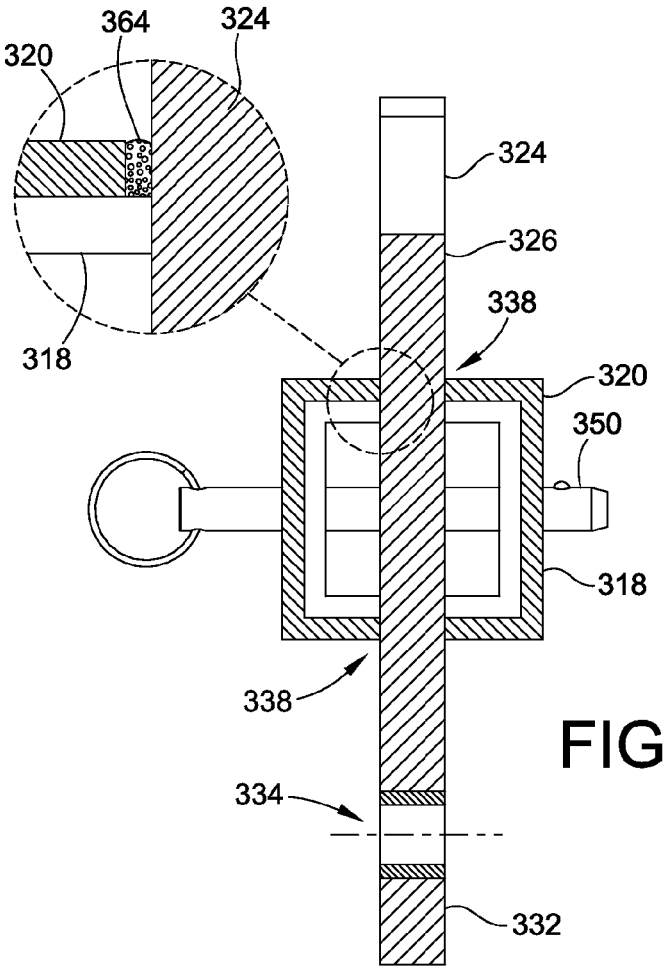
FIG. 21 is a cross sectional view of the lifting beam of FIG. 19.

With reference now to FIG. 20, beam assembly 312 includes a pair of slidable beam elements 318, 320, with a plate element in the form of connection plate 324 connected at an end of each beam element 318, 320. Beam elements 318, 320 may be formed from any composite material (including the examples discussed above) in a pultrusion process or otherwise. Plate elements 324 may be formed from metal, composites, or any other material suitable for a given application. Each beam element 318, 320 has a hollow interior, and a generally square cross sectional profile. However, the outer perimeter of beam element 318 is less than that of beam 320, such that beam element 318 may be received within the hollow interior of beam element 320.

Beam element 318 includes a plurality of apertures 336 extending through its opposed sidewalls. Likewise, beam element 320 includes a plurality of apertures 342 extending between its opposed sidewalls. Apertures 336, 342 are selectively alignable with one another and constitute an adjustment arrangement of beam assembly 312. A pin 350 may be inserted through the aligned apertures 336, 342 to adjust the overall length of beam assembly 31. The particular number of apertures 336, 342 illustrated is non-limiting, as those skilled in the art will recognize that fewer or greater apertures may be employed. Further, instead of alignable apertures, an adjustment arrangement in the form of elongated slots may be formed in each sidewall which will permit an infinite number of adjustable positions, as opposed to the finite adjustable positions defined by alignable apertures 336, 342.

Connection plates 324 include load connection portions 332 and bail connection portions 326. Load connection portions 332 include apertures 334 and define the connection arrangement for connecting beam assembly 312 to load 316. Bail connection portions 326 include apertures 356 and define the connection arrangement for connecting beam assembly 312 to lifting apparatus 314. Connection plates 324 are seated within slots 338, 340 of beam elements 318, 320, respectively. More specifically, and with reference to FIG. 21, a cross section is taken through connection plate 324 and beam element 320. As can be seen from this view, connection plate 324 is seated in slot 338, and secured to beam element 320 using adhesive 364. It will be recognized that adhesive 364 may be applied at both upper and lower slots 338 illustrated in FIG. 21. It will also be recognized that an identical approach may also be taken with connection plate 324 and beam element 318, which for purposes of brevity is not shown. The adhesive used may be any type of adhesive, including the examples discussed above, and its selection is entirely dependent upon application. Additionally, the adhered surfaces may be abraded to increase adhesion. Furthermore, in the context of composite plate elements, any known composite-to-composite joining technique may be employed.

Figure 22:
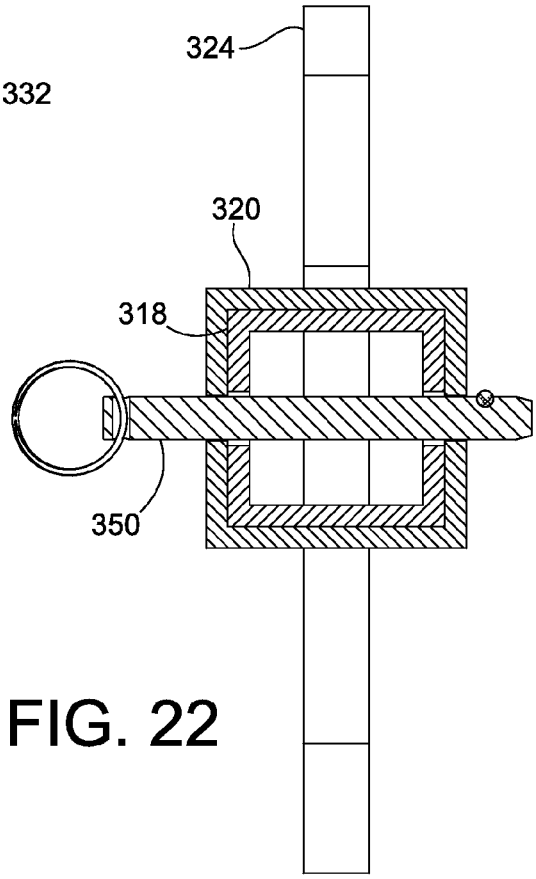
FIG. 22 is another cross sectional view of the lifting beam of FIG. 19.

Turning now to FIG. 22, the same illustrates a cross section taken through pin 350 at its point of reception in beam elements 318, 320. As can be seen in this view, beam element fits within the interior of beam element 320 in close proximity thereto. It will be recognized, particularly from inspection of FIG. 22, that beam elements 318, 320 may have other cross sectional profiles such as circular, triangular, hexagonal, etc.

Having described the structural attributes of this fourth embodiment, a description will now be provided of a general method of fabricating a beam assembly as described above. First, a pair of composite beam elements is provided. These beam elements may be formed by any known composite fabrication technique and material, including but not limited to pultrusion. Thereafter, a pair of plate elements is also provided and arranged one in each slot in each beam element. These plate elements are then joined to their respective beam element.

As described herein, embodiments of the instant invention overcome existing problems of lifting beams in the art by providing a light composite lifting beam assembly which minimizes its overall weight and assembly complexity while providing the necessary strength requirements for contemporary lifting beam applications.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A lifting beam, comprising:

a first and a second beam element each formed from a composite material, wherein the first and second beam elements are arranged in an opposed spaced relationship such that a clearance gap is formed therebetween;

a plurality of plate elements mounted to the first and second beam elements within the clearance gap;

wherein one or more of the plurality of plate elements provide a first connection arrangement for connecting the lifting beam to a lifting apparatus;

wherein one or more of the plurality of plate elements provide a second connection arrangement for connecting the lifting beam to a load;

wherein the plurality of plate elements are secured to the first and second beam elements by an adhesive, wherein the adhesive is applied to contact surfaces of each of the plurality of plate elements, and wherein the contact surfaces are positioned within the clearance gap;

further comprising a sensor mounted to one of the first or second beam elements;

wherein the sensor is a visual indicator configured to provide a visual indication of a stress loading of the one of the first or second beam elements; and wherein the visual indicator comprises a sticker providing a color indication of loading.

2. The lifting beam of claim 1, wherein the plurality of plate elements includes a pair of load plates and a bail plate positioned between the pair of load plates.

3. The lifting beam of claim 2, wherein the first connection arrangement is provided by the bail plate, and the second connection arrangement is provided by the pair of load plates.

4. The lifting beam of claim 2, wherein the first connection arrangement is provided by the pair of load plates and the bail plate, and the second connection arrangement is provided by the pair of load plates.

5. The lifting beam of claim 1, wherein the plurality of plate elements includes a pair of load plates, wherein the pair of plate elements provide the first connection arrangement and the second connection arrangement.

6. A lifting beam, comprising:

a first and a second beam element each formed from a composite material;

a plurality of plate elements mounted to the first and second beam elements; and wherein the plurality of plate elements are mounted to the first and second beam elements spaced apart from one another along a length of the first and second beam elements;

wherein the first and second beam elements are arranged in an opposed spaced relationship such that a clearance gap is formed therebetween, wherein the plurality of plate elements are secured to the first and second beam elements by an adhesive, wherein the adhesive is applied to contact surfaces of each of the plurality of plate elements, and wherein the contact surfaces are positioned within the clearance gap;

further comprising a sensor mounted to one of the first or second beam elements;

wherein the sensor is a visual indicator configured to provide a visual indication of a stress loading of the one of the first or second beam elements;

wherein the visual indicator comprises a sticker providing a color indication of loading.

7. The lifting beam of claim 6, wherein one or more of the plurality of plate elements provide a first connection arrangement for connecting the lifting beam to a lifting apparatus, and wherein one or more of the plurality of plate elements provide a second connection arrangement for connecting the lifting beam to a load.

8. The lifting beam of claim 7, wherein the plurality of plate elements includes a pair of load plates and a bail plate positioned between the pair of load plates.

9. The lifting beam of claim 8, wherein the first connection arrangement is formed on the bail plate, and the second connection arrangement is formed on the pair of load plates.

10. The lifting beam of claim 8, wherein the first connection arrangement is formed on the bail plate and the pair of load plates and the second connection arrangement is formed on the pair of load plates.

11. The lifting beam of claim 7, wherein the plurality of plate elements includes a pair of connection plates, wherein the first connection arrangement and the second connection arrangement are formed on the pair of connection plates.

12. A lifting beam, comprising:

a first and a second beam element each formed from a composite material, wherein the first and second beam elements are arranged in an opposed spaced relationship such that a clearance gap is formed therebetween;

a plurality of plate elements mounted to the first and second beam elements within the clearance gap;

wherein one or more of the plurality of plate elements provide a first connection arrangement for connecting the lifting beam to a lifting apparatus;

wherein one or more of the plurality of plate elements provide a second connection arrangement for connecting the lifting beam to a load;

wherein the plurality of plate elements are secured to the first and second beam elements by an adhesive, wherein the adhesive is applied to contact surfaces of each of the plurality of plate elements, and wherein the contact surfaces are positioned within the clearance gap;

further comprising a sensor mounted to one of the first or second beam elements;

wherein the sensor is a visual indicator configured to provide a visual indication of a stress loading of the one of the first or second beam elements; and wherein the visual indicator is a sticker which tears at a given stress of said one of the first or second beam elements.

13. A lifting beam, comprising:

a first and a second beam element each formed from a composite material;

a plurality of plate elements mounted to the first and second beam elements; and wherein the plurality of plate elements are mounted to the first and second beam elements spaced apart from one another along a length of the first and second beam elements;

wherein the first and second beam elements are arranged in an opposed spaced relationship such that a clearance gap is formed therebetween, wherein the plurality of plate elements are secured to the first and second beam elements by an adhesive, wherein the adhesive is applied to contact surfaces of each of the plurality of plate elements, and wherein the contact surfaces are positioned within the clearance gap;

further comprising a sensor mounted to one of the first or second beam elements;

wherein the sensor is a visual indicator configured to provide a visual indication of a stress loading of the one of the first or second beam elements;

wherein the visual indicator is a sticker which tears at a given stress of said one of the first or second beam elements.

* * * * *